US010230156B2

(12) United States Patent
Hallivuori

(10) Patent No.: US 10,230,156 B2
(45) Date of Patent: Mar. 12, 2019

(54) APPARATUS FOR WIRELESS COMMUNICATION

(75) Inventor: Juha Samuel Hallivuori, Tampere (FI)

(73) Assignee: Nokia Technologies Oy, Espoo (FI)

( * ) Notice: Subject to any disclaimer, the term of this patent is extended or adjusted under 35 U.S.C. 154(b) by 348 days.

(21) Appl. No.: 14/355,302

(22) PCT Filed: Nov. 3, 2011

(86) PCT No.: PCT/IB2011/054904

§ 371 (c)(1),
(2), (4) Date: Jul. 24, 2014

(87) PCT Pub. No.: WO2013/064863

PCT Pub. Date: May 10, 2013

(65) Prior Publication Data

US 2014/0361936 A1 Dec. 11, 2014

(51) Int. Cl.

| | |
|---|---|
| ***H01Q 1/24*** | (2006.01) |
| ***H01Q 1/48*** | (2006.01) |
| ***H01Q 5/314*** | (2015.01) |
| ***H01Q 5/328*** | (2015.01) |

(52) U.S. Cl.

CPC ..... *H01Q 1/243* (2013.01); *H01Q 1/48* (2013.01); *H01Q 5/314* (2015.01); *H01Q 5/328* (2015.01); *Y10T 29/49018* (2015.01)

(58) Field of Classification Search

CPC ..... H01Q 1/243; H01Q 1/48; H01Q 5/314; H01Q 5/328

USPC ..... 343/702

See application file for complete search history.

(56) References Cited

U.S. PATENT DOCUMENTS

| | | | |
|---|---|---|---|
| 5,767,810 | A | 6/1998 | Hagiwara et al. |
| 6,407,704 | B1 | 6/2002 | Franey et al. |
| 7,375,695 | B2 | 5/2008 | Ishizuka et al. |
| 7,612,725 | B2 | 11/2009 | Hill et al. |
| 7,768,462 | B2 | 8/2010 | Zhang et al. |

(Continued)

FOREIGN PATENT DOCUMENTS

| | | | |
|---|---|---|---|
| EP | 2302737 | A1 | 3/2011 |
| EP | 2355242 | A1 | 8/2011 |
| WO | 2011/131247 | A1 | 10/2011 |

OTHER PUBLICATIONS

Extended European Search Report received for corresponding European Patent Application No. 11874884.7, dated Jun. 1, 2015, 6 pages.

(Continued)

*Primary Examiner* — Dieu Hien T Duong
*Assistant Examiner* — Bamidele A Jegede
(74) *Attorney, Agent, or Firm* — Harrington & Smith

(57) ABSTRACT

An apparatus comprising: a ground member configured to receive one or more antennas, the one or more antennas being configured to operate in at least a first operational resonant frequency band; and a cover defining an exterior surface of the apparatus and including a conductive cover portion, the conductive cover portion being coupled to the ground member via a first reactive component to form a first resonant circuit configured to resonate at least partially in the first operational resonant frequency band, and via at least a second reactive component to form at least a second resonant circuit configured to resonate at least partially in at least the first operational resonant frequency band.

17 Claims, 4 Drawing Sheets

(56) References Cited

U.S. PATENT DOCUMENTS

| | | | | |
|---|---|---|---|---|
| 7,876,273 | B2 | 1/2011 | Breiter et al. | |
| 8,212,735 | B2 | 7/2012 | Hyvonen et al. | |
| 2004/0066336 | A1* | 4/2004 | De Graauw | H01Q 9/0421 343/700 MS |
| 2006/0145930 | A1* | 7/2006 | Faraone | H01Q 1/242 343/702 |
| 2006/0262015 | A1 | 11/2006 | Thornell-Pers et al. | |
| 2007/0052596 | A1 | 3/2007 | Liu et al. | |
| 2007/0238492 | A1 | 10/2007 | Kaneko et al. | |
| 2009/0160713 | A1* | 6/2009 | Nielsen | H01Q 1/243 343/702 |
| 2009/0322623 | A1* | 12/2009 | Xie | H01Q 1/243 343/702 |
| 2010/0073244 | A1* | 3/2010 | Hui | H01Q 1/243 343/702 |
| 2010/0087235 | A1 | 4/2010 | Chiang | |
| 2010/0123633 | A1* | 5/2010 | Ozden | H01Q 1/243 343/702 |
| 2011/0148718 | A1* | 6/2011 | Wang | H01Q 1/243 343/702 |
| 2011/0187606 | A1 | 8/2011 | Wong et al. | |
| 2011/0254741 | A1* | 10/2011 | Ishimiya | H01Q 1/243 343/702 |
| 2011/0273361 | A1* | 11/2011 | Autti | H01Q 1/243 343/904 |
| 2013/0214979 | A1* | 8/2013 | McMilin | H01Q 9/42 343/750 |
| 2013/0214986 | A1* | 8/2013 | Zhu | H01Q 1/243 343/848 |

OTHER PUBLICATIONS

International Search Report received for corresponding Patent Cooperation Treaty Application No. PCT/IB2011/054904, dated Mar. 7, 2012, 4 pages.

Texas Instruments "*PCB Design Guidelines for Reduced EMI*" Nov. 1999.

Cameron Katrai and Chris Areus "*EMI Reduction Techniques*" Dec. 29, 1998.

* cited by examiner

APPARATUS FOR WIRELESS COMMUNICATION

RELATED APPLICATION

This application was originally filed as PCT Application No. PCT/IB2011/054904 filed Nov. 3, 2011.

TECHNOLOGICAL FIELD

Embodiments of the present invention relate to apparatus for wireless communication. In particular, they relate to apparatus for wireless communication in a portable electronic communication device.

BACKGROUND

Apparatus, such as mobile cellular telephones, usually include an antenna arrangement for wireless communication. The antenna arrangement is usually housed within a cover and is therefore positioned within the apparatus. Since the cover defines the exterior visible surface of the apparatus, users often demand that the cover has aesthetic appeal and be durable in order to protect the electronic components housed within.

In recent years, metallic covers have become increasingly popular due to their attractive appearance and durable nature. However, such metallic covers usually electromagnetically interfere with the antenna arrangement and may cause the antenna arrangement to be relatively inefficient in operation.

Therefore, it would be desirable to provide an alternative apparatus.

BRIEF SUMMARY

According to various, but not necessarily all, embodiments of the invention there is provided an apparatus comprising: a ground member configured to receive one or more antennas, the one or more antennas being configured to operate in at least a first operational resonant frequency band; and a cover defining an exterior surface of the apparatus and including a conductive cover portion, the conductive cover portion being coupled to the ground member via a first reactive component to form a first resonant circuit configured to resonate at least partially in the first operational resonant frequency band, and via at least a second reactive component to form at least a second resonant circuit configured to resonate at least partially in at least the first operational resonant frequency band.

The apparatus may be for wireless communication.

The conductive cover portion may be substantially cuboid in shape and may define an aperture configured to receive a display.

The conductive cover portion may include one or more metals.

The apparatus may further comprise an electrical component, the second reactive component being configured to reduce electromagnetic coupling between the conductive cover portion and the ground member via the electrical component.

The electrical component may be an electrical energy storage device.

The second reactive component may include a conductive plate positioned in an overlaying relationship with the electrical component.

The ground member may have a first end and a second opposite end, the first reactive component may be positioned at the first end, and the second reactive component and the one or more antennas may be positioned at the second end.

According to various, but not necessarily all, embodiments of the invention there is provided an electronic communication device comprising an apparatus as described in any of the preceding paragraphs.

The electronic communication device may further comprise a display.

According to various, but not necessarily all, embodiments of the invention there is provided a module comprising an apparatus as described in any of the preceding paragraphs.

According to various, but not necessarily, all embodiments of the invention there is provided a method comprising: providing a ground member configured to receive one or more antennas, the one or more antennas being configured to operate in at least a first operational resonant frequency band; and providing a cover defining an exterior surface of the apparatus and including a conductive cover portion, the conductive cover portion being coupled to the ground member via a first reactive component to form a first resonant circuit configured to resonate at least partially in the first operational resonant frequency band, and via at least a second reactive component to form at least a second resonant circuit configured to resonate at least partially in at least the first operational resonant frequency band.

The conductive cover portion may be substantially cuboid in shape and may define an aperture configured to receive a display.

The conductive cover portion may include one or more metals.

The method may further comprise providing an electrical component, the second reactive component may be configured to reduce electromagnetic coupling between the conductive cover portion and the ground member via the electrical component.

The electrical component may be an electrical energy storage device.

The second reactive component may include a conductive plate positioned in an overlaying relationship with the electrical component.

The ground member may have a first end and a second opposite end, the first reactive component may be positioned at the first end, and the second reactive component and the one or more antennas may be positioned at the second end.

BRIEF DESCRIPTION

For a better understanding of various examples of embodiments of the present invention reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

Figure 2:
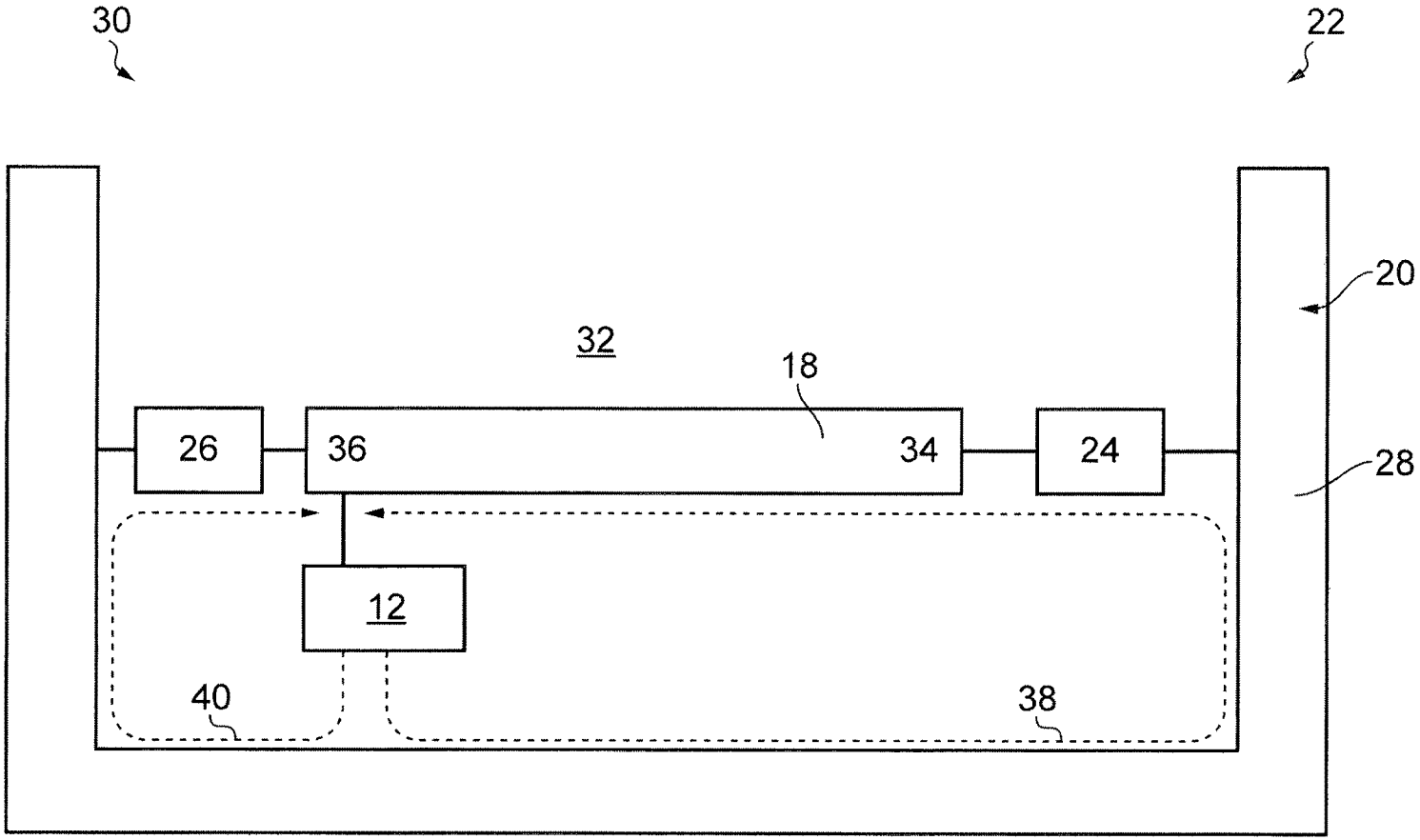
FIG. 2 illustrates a schematic cross sectional side view of an apparatus according to various embodiments of the invention.
Figure 3:
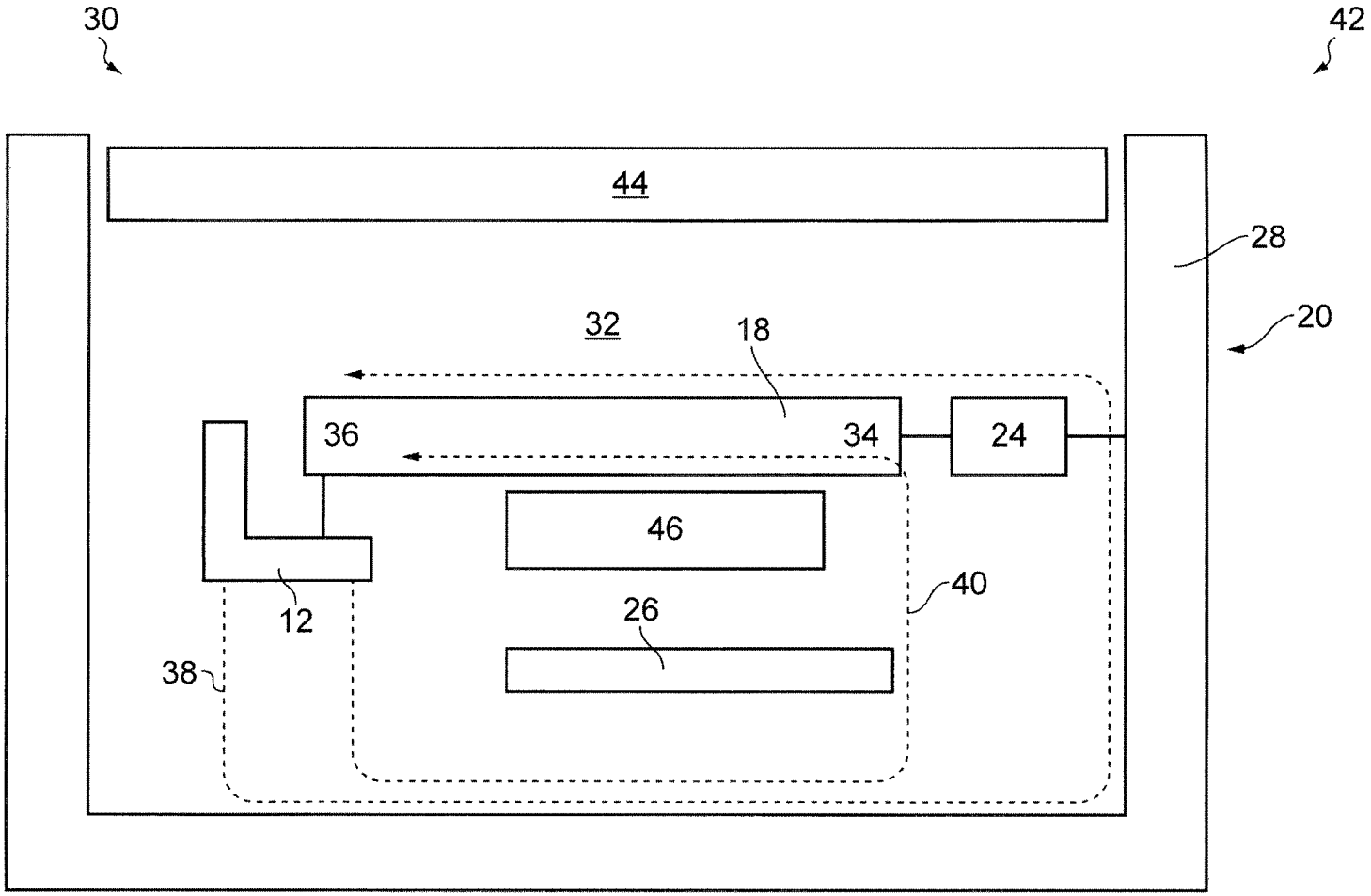
FIG. 3 illustrates a schematic cross sectional side view of another apparatus according to various embodiments of the invention.

FIGS. 2 and 3 illustrate an apparatus 22, 42 comprising: a ground member 18 configured to receive one or more antennas 12, the one or more antennas 12 being configured to operate in at least a first operational resonant frequency band; and a cover 20 defining an exterior surface of the apparatus 22, 42 and including a conductive cover portion 28, the conductive cover portion 28 being coupled to the ground member 18 via a first reactive component 24 to form a first resonant circuit 38 configured to resonate at least partially in the first operational resonant frequency band, and via at least a second reactive component 26 to form at least a second resonant circuit 40 configured to resonate at least partially in at least the first operational resonant frequency band.

Figure 1:
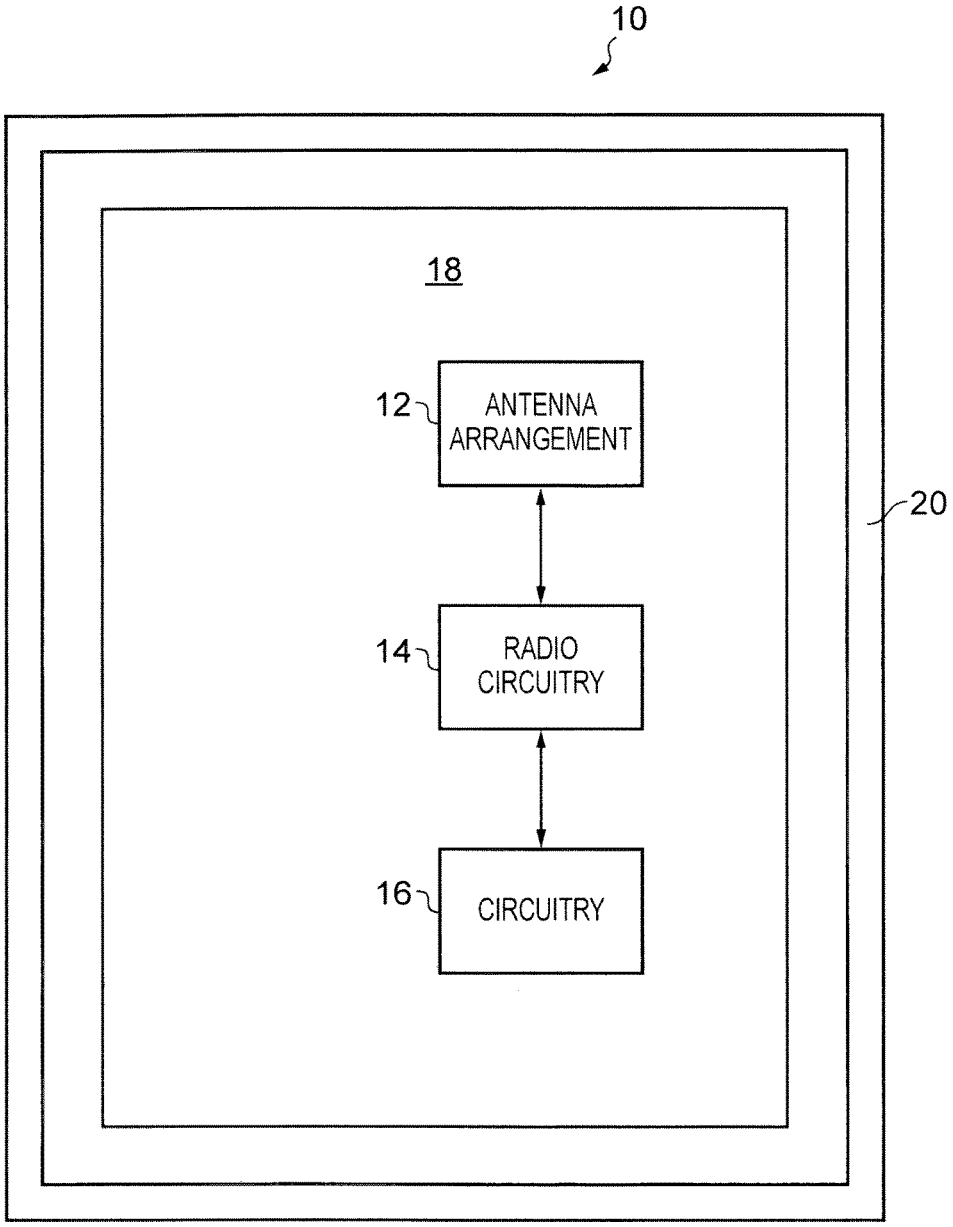
FIG. 1 illustrates a schematic diagram of an electronic communication device according to various embodiments of the invention.

In more detail, FIG. 1 illustrates an electronic communication device 10 which may be any apparatus such as a hand portable electronic communication device (for example, a mobile cellular telephone, a tablet computer, a laptop computer, a personal digital assistant or a hand held computer), a non-portable electronic device (for example, a personal computer or a base station for a cellular network), a portable multimedia device (for example, a music player, a video player, a game console and so on) or a module for such devices. As used here, 'module' refers to a unit or apparatus that excludes certain parts or components that would be added by an end manufacturer or a user.

The electronic communication device 10 comprises an antenna arrangement 12, radio circuitry 14, circuitry 16, a ground member 18 and a cover 20. The antenna arrangement 12 includes one or more antennas that are configured to transmit and receive, transmit only or receive only electromagnetic signals.

The radio circuitry 14 is connected between the antenna arrangement 12 and the circuitry 16 and may include a receiver and/or a transmitter. The circuitry 16 is operable to provide signals to, and/or receive signals from the radio circuitry 14. The electronic communication device 10 may optionally include one or more matching circuits between the antenna arrangement 12 and the radio circuitry 14.

The radio circuitry 14 and the antenna arrangement 12 may be configured to operate in a plurality of operational resonant frequency bands and via one or more protocols. For example, the operational frequency bands and protocols may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); helical local area network (HLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which an antenna can efficiently operate using a protocol is a frequency range where the antenna's return loss is less than an operational threshold. For example, efficient operation may occur when the antenna's return loss is better than (that is, less than) −4 dB or −6 dB.

In the embodiment where the electronic communication device 10 is a portable electronic communication device (such as a mobile phone), the circuitry 16 may include a processor, a memory and input/output devices such as an audio input device (a microphone for example), an audio output device (a loudspeaker for example) and a display.

The antenna arrangement 12 and the electronic components that provide the radio circuitry 14 and the circuitry 16 may be interconnected via the ground member 18 (for example, a printed wiring board). The ground member 18 may be used as a ground plane for the antenna arrangement 12 by using one or more layers of the printed wiring board 18. In other embodiments, some other conductive part of the electronic communication device 10 (a battery cover for example) may be used as the ground member 18 for the antenna arrangement 12. In some embodiments, the ground member 18 may be formed from several conductive parts of the electronic communication device 10. The ground member 18 may be planar or non-planar.

The cover 20 defines the exterior visible surface of the electronic communication device 10 and is configured to house the electronic components of the electronic communication device 20 such as the antenna arrangement 12, the radio circuitry 14, the circuitry 16 and the ground member 18. The cover 20 comprises a conductive cover portion that may form part or all of the cover 20. Furthermore, in some embodiments the cover 20 may comprise a plurality of conductive cover portions that may or may not be galvanically connected to one another. The conductive cover portion may comprise any conductive material and may comprise one or more metals and/or one or more conductive polymers for example.

FIG. 2 illustrates a schematic cross sectional side view of an apparatus 22 according to various embodiments of the invention. The apparatus 22 includes a cover 20, a ground member 18, an antenna 12, a first reactive component 24 and a second reactive component 26.

In this embodiment, the cover 20 includes a conductive cover portion 28 that forms substantially all of the cover 20.

The conductive cover portion 28 is substantially cuboid in shape (but may have curved edges) and defines an aperture 30 on its upper surface that is dimensioned and shaped to receive a display (such as a touch screen display). The conductive cover portion 28 also defines a cavity 32 in which the electronic components of the electronic communication device 10 may be housed. Consequently, it should be appreciated that the conductive cover portion 28 has a 'bath tub' shape.

The ground member 18 is positioned within the cavity 32 defined by the conductive cover portion 28 and has a first end 34 and a second opposite end 36. The ground member 18 is configured to receive one or more antennas (such as antenna 12 illustrated in FIG. 2). By way of an example, the ground member 18 may be configured to receive one or more antennas by comprising one or more ports that are connected to the radio circuitry 14 and to which the one or more antennas may be connected.

The antenna 12 may be any suitable antenna and may be, for example, a planar inverted F antenna (PIFA), an inverted F antenna (IFA), a planar inverted L antenna (PILA), an inverted L antenna (ILA), a loop antenna or a monopole antenna. The antenna 12 is connected to the second end 36 of the ground member 18 and is positioned between the ground member 18 and the bottom surface of the conductive cover portion 28. The antenna 12 may be connected to a feed point and a ground point (depending on the type of antenna) at the second end 36. The feed point is connected to the radio circuitry 14. The antenna 12 is configured to operate in at least a first operational resonant frequency band (which may be, but not limited to, any of the operational frequency bands mentioned in the preceding paragraphs).

The first reactive component 24 is connected between the conductive cover portion 28 and the first end 34 of the ground member 18. The first reactive component 24 may be galvanically connected to the conductive cover portion 28 or may be electromagnetically connected to the conductive cover portion 28. Similarly, the first reactive component 24 may be galvanically connected to the ground member 18 or may be electromagnetically connected to the ground member 18. The first reactive component 24 may include any suitable reactive elements or circuitry and may include lumped components such as capacitors and inductors, or alternatively be distributed components such as microstrip lines or striplines which form capacitors and/or inductors. In some embodiments, the first reactive component 24 may include one or more conductive plates that are configured to capacitively couple to the conductive cover portion 28 and/or the ground member 18.

The first reactive component 24 may be disposed on the ground member 18 or alternatively separate to the ground member 18 and the conductive cover portion 28. In some embodiments the first reactive component 24 may be disposed on the conductive cover portion where the conductive cover portion is provided on a plastic housing as a conductive layer or layers, for example, by laser direct structuring (LDS) or molded interconnect device (MID) techniques.

The second reactive component 26 is connected between the conductive cover portion 28 and the second end 36 of the ground member 18. The second reactive component 26 may be galvanically connected to the conductive cover portion 28 or may be electromagnetically connected to the conductive cover portion 28. Similarly, the second reactive component 26 may be galvanically connected to the ground member 18 or may be electromagnetically connected to the ground member 18. The second reactive component 26 may include any suitable reactive elements or circuitry and may include lumped components such as capacitors and inductors, or alternatively be distributed components such as microstrip lines or striplines which form capacitors and/or inductors. In some embodiments, the second reactive component 26 may include one or more conductive plates that are configured to capacitively couple to the conductive cover portion 28 and/or the ground member 18.

The second reactive component 26 may be disposed on the ground member 18 or alternatively separate to the ground member 18 and the conductive cover portion 28. In some embodiments the second reactive component 26 may be disposed on the conductive cover portion where the conductive cover portion is provided on a plastic housing as a conductive layer or layers, for example, by laser direct structuring (LDS) or molded interconnect device (MID) techniques.

It should be appreciated that in other embodiments, the first reactive component 24 and/or the second reactive component 26 may be positioned in different locations within the cavity 32 defined by the conductive cover portion 28 and may connect or couple to different regions of the ground member 18 and the conductive cover portion 28.

The antenna 12, the conductive cover portion 28, the first reactive component 24 and the ground member 18 form a first resonant circuit 38. The first resonant circuit 38 has an electrical length (which may be selected by choosing an appropriate reactance value or values for the first reactive component 24) that results in the first resonant circuit 38 being at least partially resonant in the first operational resonant frequency band. In other words, the electrical length of the first resonant circuit 38 is selected so that at the first operational resonant frequency band, the first resonant circuit 38 has substantially no capacitive or inductive impedance. Since the first resonant circuit 38 is at least partially resonant in the first operational resonant frequency band, the first resonant circuit 38 enables the apparatus 22 to wirelessly communicate in the first operational resonant frequency band. In various embodiments, the first resonant circuit 38 is configured to serially resonate at least partially in the first operational resonant frequency band.

The antenna 12, the conductive cover portion 28, the second reactive component 26 and the ground member 18 form a second resonant circuit 40. The second resonant circuit 40 has an electrical length (which may be selected by choosing an appropriate reactance value or values for the second reactive component 26) that results in the second resonant circuit 40 being at least partially resonant in the first operational resonant frequency band. In other words, the electrical length of the second resonant circuit 40 is selected so that at the first operational resonant frequency band, the second resonant circuit 40 has substantially no capacitive or inductive impedance. Since the second resonant circuit 40 is at least partially resonant in the first operational resonant frequency band, the second resonant circuit 40 enables the apparatus 22 to wirelessly communicate in the first operational resonant frequency band. In various embodiments, the second resonant circuit 40 is configured to serially resonate at least partially in the first operational resonant frequency band. In some embodiments, the resonant frequency of the second resonant circuit 40 may be different to the resonant frequency of the first resonant circuit 38

Various embodiments of the present invention provide an advantage in that the first and second resonant circuits 38, 40 render the conductive cover portion 28 part of the overall antenna structure and enable the apparatus 28 to efficiently operate in the first operational resonant frequency band. This may enable the cover 20 to be a fully metallised cover of any size that has no apertures that are specifically designed and provided to enable the passage of radio waves there through. It should be appreciated that this will advantageously increase the design freedom of the designer of the cover 20 since he or she will not be required to design any apertures (for example, a plastic or non-conductive window through which the antenna can radiate efficiently) in the cover 20 to enable wireless communication.

In some embodiments, the antenna 12 may be resonant in a second different operational resonant frequency band, or the apparatus 22 may include another antenna that is resonant in a second different operational resonant frequency band. In these embodiments, one or both of the first and second resonant circuits 38, 40 may be advantageously configured (through selecting appropriate impedances for the first and second reactive components 24, 26) to also resonate in the second operational resonant frequency band and thereby enable efficient operation in the second operational resonant frequency band. For example, the first operational resonant frequency band may be a 'low' band such as global system for mobile communications (EGSM) 900 (880-960 MHz) and the second operational resonant frequency band may be a 'high' band such as global system for mobile communications (EGSM) 1800 (1710-1880 MHz).

FIG. 3 illustrates a schematic cross sectional side view of another apparatus 42 according to various embodiments of the invention. The apparatus 42 illustrated in FIG. 3 is similar to the apparatus 22 illustrated in FIG. 2 and where the features are similar, the same reference numerals are used. The apparatus 42 differs from the apparatus 22 in that the apparatus 42 also includes a display 44 and an electrical component 46.

The display 44 is positioned in the aperture 30 and may be any suitable display and may be an active matrix organic light emitting diode (AMOLED) display, an organic light emitting diode (OLED) display, a light emitting diode (LED) display or a liquid crystal display (LCD). The display 44 may be a touch screen display or a non touch screen display and may include a back plate. The back plate may be fully metallic, may include a metallic portion or may comprise no metal or other conductive material. Metal components of the display 44 may be connected to the cover 20 via a direct connection, via a capacitive coupling or via one or more reactive components.

For example, the display 44 may be coupled to the cover 20 via a non conductive material (that is, the display 44 and the cover 20 are coupled via a non-conductive display frame and are not galvanically connected). In some embodiments, a frame of the display 44 may be conductive and there is a relatively small gap between the cover 20 and the display frame so that they are not galvanically connected. In other embodiments where the display 44 is galvanically connected to the cover 20, the display 44 is also connected to the ground member 18 via a third reactive component that is configured to provide a third resonant circuit that is also at least partially resonant in the first operational resonant frequency band.

The electrical component 46 may be any electrical component of the apparatus 42 and may be, for example, an electrical energy storage device such as a battery or an electric double layer capacitor (which may also be referred to as a 'supercapacitor'), any circuitry such as a processor or a memory, or an audio device such as a loudspeaker or a microphone. The electrical component 46 may include any circuitry that loads the antenna and/or reduces the antenna performance quality. The electrical component 46 is positioned between the ground member 18 and the bottom surface of the conductive cover portion 28. In other embodiments, the electrical component 46 may be positioned between the display 44 and the ground member 18.

The second reactive component 26 includes a conductive plate that is positioned between the electrical component 46 and the conductive cover portion 28. The conductive plate 26 is positioned in an overlaying relationship with the electrical component 46 (when viewed in plan) and may be planar or non-planar. The conductive plate 26 may be galvanically coupled or electromagnetically coupled to the conductive cover portion 28 and the ground member 18. The conductive plate 26 may only partially overlay the electrical component 46.

As described above with reference to FIG. 2, the antenna 12, the conductive cover portion 28, the first reactive component 24 and the ground member 18 form a first resonant circuit 38 that is configured to resonate in the first operational resonant frequency band.

A second resonant circuit 40 is formed from the antenna 12, the conductive cover portion 28, the second reactive component 26 and the ground member 18. The second resonant circuit 40 is configured to resonate in the first operational resonant frequency band (for example, the dimensions and positioning of the conductive plate 26 may be selected in order to achieve a desired resonant frequency band for second resonant circuit 40).

Various embodiments of the present invention provide an advantage in that the conductive plate 26 may be dimensioned and positioned so that at the first operational resonant frequency band, the path to the ground member 18 from the conductive cover portion 28 via the conductive plate 26 has a lower impedance than the path to the ground member 18 from the conductive cover portion 28 via the electrical component 46. Consequently, the second resonant circuit 40 reduces the flow of current in the path from the conductive cover portion 28 to the ground member 18 via the electrical component 46 and thus renders the electrical component 46 effectively invisible to the operation of the antenna 12 and enables the apparatus 42 to efficiently operate in the first operational resonant frequency band. When the electrical component 46 is a battery, the battery may provide a lossy radio frequency (RF) path to ground (ground member 18), which couples RF signals flowing in the conductive cover portion 28. This coupling of the RF signals from the conductive cover portion 28 to the ground member 18 via the battery leads to an inefficient antenna operation.

Figure 4:
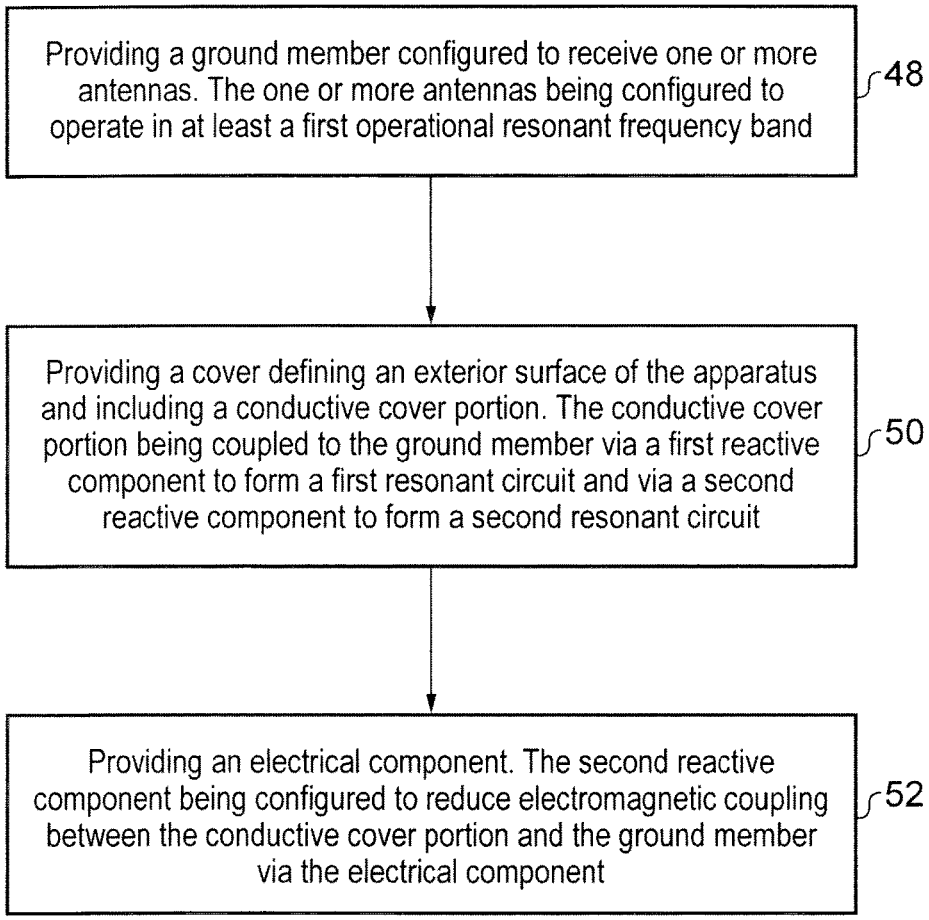
FIG. 4 illustrates a flow diagram of a method of manufacturing an apparatus according to various embodiments of the invention.

FIG. 4 illustrates a flow diagram of a method of manufacturing an apparatus 22, 42 according to various embodiments of the invention. At block 48, the method includes providing a ground member 18 configured to receive one or more antennas 12 that are operable in at least a first operational resonant frequency band.

At block 50, the method includes providing a cover 20 defining an exterior surface of the apparatus 22, 42 and including a conductive cover portion 28. The conductive cover portion 28 is configured to couple to the ground member 18 via a first reactive component 24 to form a first resonant circuit 38 and via a second reactive component 26 to form a second resonant circuit 40.

At block 52, the method optionally includes providing an electrical component 46. The second reactive component 26 is configured to reduce electromagnetic coupling between the conductive cover portion 28 and the ground member 18 via the electrical component 46.

The blocks illustrated in the FIG. 4 may represent steps in a method and/or sections of code in a computer program. For example, a processor may read a memory storing the computer program to execute the computer program to control machinery to perform the method illustrated in FIG. 4. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, embodiments of the invention may include any number of reactive components that form any number of resonant circuits.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a ground member configured to receive one or more antennas, the one or more antennas being configured to operate in at least a first operational resonant frequency band; and a cover defining an exterior surface of the apparatus and including a conductive cover portion, the conductive cover portion being coupled to the ground member via a first reactive component, wherein the one or more antennas, the conductive cover portion, the ground member and the first reactive component form a first resonant circuit configured to resonate at least partially in the first operational resonant frequency band, wherein the conductive cover portion is coupled to the ground member via at least a second reactive component, wherein the one or more antennas, the conductive cover portion, the ground member and the second reactive component form at least a second resonant circuit configured to resonate at least partially in at least the first operational resonant frequency band, wherein the first reactive component is configured to be coupled to a first region of the ground member and a first region of the conductive cover portion, and wherein the second reactive component is configured to be coupled to a second region of the ground member, different from the first region of the ground member, and to a second region of the conductive cover member, different from the first region of the conductive cover portion.

2. The apparatus of claim 1, wherein the conductive cover portion is substantially cuboid in shape and defines an aperture configured to receive a display.

3. The apparatus of claim 1, wherein the conductive cover portion includes one or more metals.

4. The apparatus of claim 1, further comprising an electrical component, the second reactive component being configured to reduce electromagnetic coupling between the conductive cover portion and the ground member via the electrical component.

5. The apparatus of claim 4, wherein the electrical component is an electrical energy storage device.

6. An apparatus as claimed in claim 4, wherein the second reactive component includes a conductive plate positioned in an overlaying relationship with the electrical component.

7. The apparatus of claim 1, wherein the ground member has a first end and a second opposite end, the first reactive component being positioned at the first end, and the second reactive component and the one or more antennas being positioned at the second end.

8. An electronic communication device comprising in the apparatus of claim 1.

9. The electronic communication device of claim 8, further comprising a display.

10. A module comprising in the apparatus of claim 1.

11. A method comprising:

providing a ground member configured to receive one or more antennas, the one or more antennas being configured to operate in at least a first operational resonant frequency band; and providing a cover defining an exterior surface of the apparatus and including a conductive cover portion, the conductive cover portion being coupled to the ground member via a first reactive component and wherein the one or more antennas, wherein the conductive cover portion, the ground member and the first reactive component form a first resonant circuit configured to resonate at least partially in the first operational resonant frequency band, wherein the conductive cover portion is coupled to the ground member via at least a second reactive component, wherein the one or more antennas, the conductive cover portion, the ground member and the second reactive component form at least a second resonant circuit configured to resonate at least partially in at least the first operational resonant frequency band, wherein the first reactive component is configured to be coupled to a first region of the ground member and a first region of the conductive cover portion, and wherein the second reactive component is configured to be coupled to a second region of the ground member, different from the first region of the ground member, and to a second region of the conductive cover member, different from the first region of the conductive cover portion.

12. The method of claim 11, wherein the conductive cover portion is substantially cuboid in shape and defines an aperture configured to receive a display.

13. The method of claim 11, wherein the conductive cover portion includes one or more metals.

14. The method of claim 11, further comprising providing an electrical component, the second reactive component being configured to reduce electromagnetic coupling between the conductive cover portion and the ground member via the electrical component.

15. The method of claim 14, wherein the electrical component is an electrical energy storage device.

16. The method of claim 14, wherein the second reactive component includes a conductive plate positioned in an overlaying relationship with the electrical component.

17. The method of claim 11, wherein the ground member has a first end and a second opposite end, the first reactive component being positioned at the first end, and the second reactive component and the one or more antennas being positioned at the second end.

* * * * *